US005762052A

United States Patent [19]

Minkov et al.

[11] Patent Number: 5,762,052

[45] Date of Patent: Jun. 9, 1998

[54] SYSTEM FOR STARTING OF INTERNAL COMBUSTION GASOLINE ENGINES

[76] Inventors: George M. Minkov, Strelcha #5; Hristo Atanasov Bachvarov, 73 Cherkovna, both of Sofia 1000, Bulgaria

[21] Appl. No.: 768,253

[22] Filed: Dec. 17, 1996

[30] Foreign Application Priority Data

Jan. 22, 1996 [BG] Bulgaria ..... 100297

[51] Int. Cl.[6] ..... F02P 3/06

[52] U.S. Cl. ..... 123/607

[58] Field of Search ..... 123/606, 607, 123/648, 628; 315/209; 431/255, 263, 2

[56] References Cited

U.S. PATENT DOCUMENTS

| | | | |
|---|---|---|---|
| 3,032,683 | 5/1962 | Ruckelshaus | 123/607 |
| 3,161,803 | 12/1964 | Knittweis | 123/607 |
| 3,593,696 | 7/1971 | Guido | 123/607 |
| 4,320,735 | 3/1982 | Canup | 123/606 |
| 4,445,492 | 5/1984 | Rouanes | 123/606 |
| 4,710,681 | 12/1987 | Zikovich | 315/209 T |
| 4,820,957 | 4/1989 | Zikovich | 315/209 T |
| 4,932,387 | 6/1990 | Flam et al. | 123/607 |
| 5,456,241 | 10/1995 | Ward | 123/598 |
| 5,513,618 | 5/1996 | Rich et al. | 123/598 |

*Primary Examiner*—Raymond A. Nelli

*Attorney, Agent, or Firm*—Rader, Fishman & Grauer PLLC

[57] ABSTRACT

An ignition control system for internal combustion engines including a high frequency generator and a means of commutating the high frequency signal with a signal synchronized to the engine rotational speed. The commutated high frequency signal is amplified and sent through a step up transformer whereby it is applied to the spark plugs of an internal combustion engine. The high frequency nature of the ignition signal provides distinct advantages (more complete burning of gasses) when used on internal combustion engines having lean air fuel mixtures in the range of 20:1.

14 Claims, 1 Drawing Sheet

FIG 1
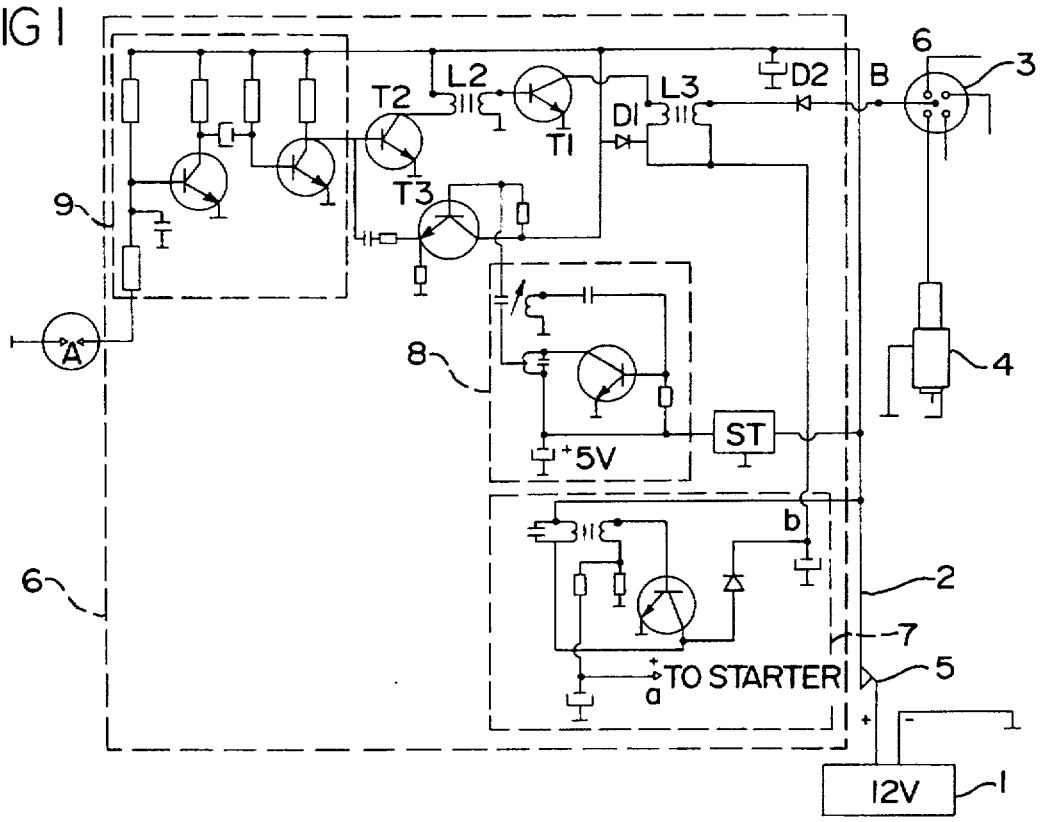
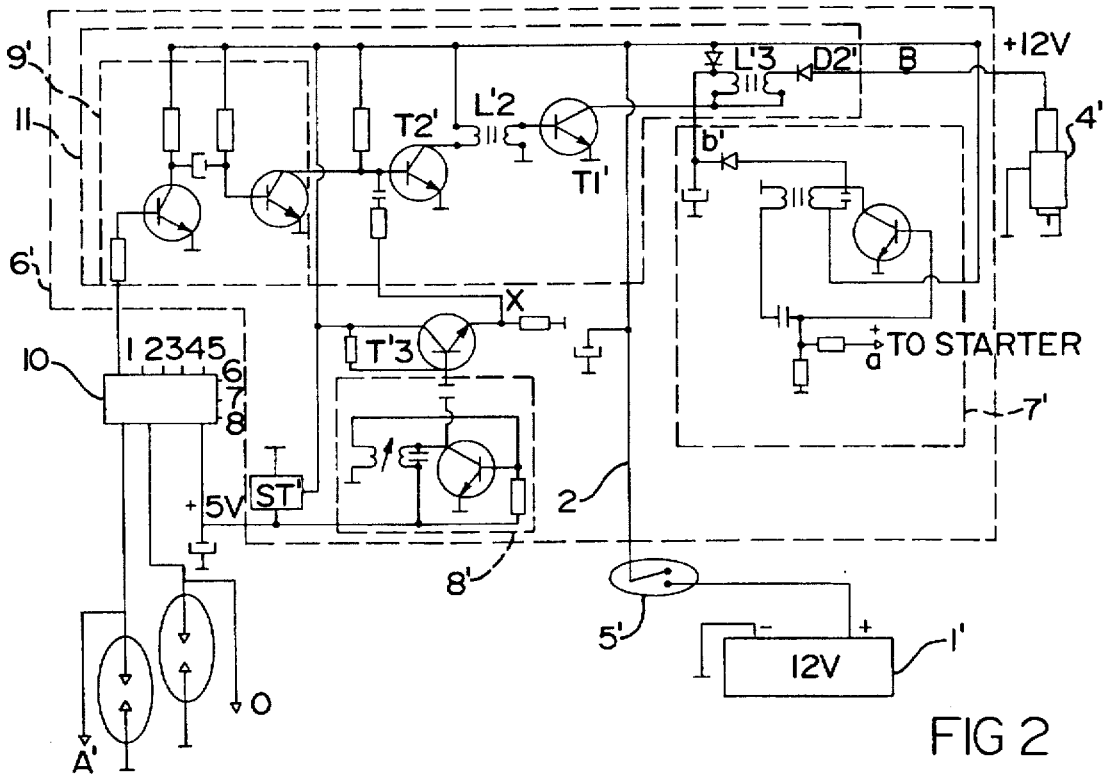
FIG 2

SYSTEM FOR STARTING OF INTERNAL COMBUSTION GASOLINE ENGINES

TECHNICAL FIELD

The invention relates to ignition systems and more particularly relates to ignition systems for use with internal combustion engines.

BACKGROUND OF THE INVENTION

Battery powered ignition systems for gasoline engines have been used for many years. They typically include a step up voltage transformer (commonly referred to as an ignition coil), with its primary winding connected to the vehicle battery, and its secondary winding connected to a high voltage distributor that distributes the high voltage generated by the coil to the sparkplugs. The primary winding is commuted (i.e. switched on and off) by circuit breaker (a "breaker arm—fixed break contact" type) or by an electronic switch to generate the high voltage spark for the engine's ignition. The high voltage spark typically used in modern ignition systems is a single, low-energy spark having 0.2–0.5 mJ, of energy and accordingly it is not capable of supporting the ignition of lean fuel mixtures in the range of 20 pounds air to 1 kilogram fuel. This shortcoming of modern ignition systems is an impediment to their use in lean burn engines.

In addition to the above-referenced drawback associated with modern ignition systems, when the commutation rate is increased (at higher engine rotational speed) the output voltage of the coil tends to decrease—in extreme cases as much as 50 percent. Thus when a hi-energy ignition spark is demanded by the engine, traditional ignition systems are incapable of meeting such demands. As a result, unburned hydrocarbons are present in the exhaust and the use of a catalytic convertor is necessary.

Thus an object of the present invention is to increase the energy level of the ignition spark as. Another object of the present invention is to maintain a constant ignition voltage independent of engine rotational speed. It is a further object of the invention to provide an ignition system capable of generating an ignition spark of sufficient duration and intensity such that a nearly complete burn of the air/fuel charge is achieved, thereby eliminating the need for a catalytic convertor.

The present invention accomplishes these objectives by using a source of low voltage (battery); high voltage distributor; sparkplug; main circuit connected to the battery; contact key and source of ignition signal (originated by the engine); a high frequency, high power signal generating device connected to the high voltage distributor and sparkplug that receive the high frequency voltage rectified signal with negative polarization, that originates from the output of the high frequency; and high power signal generating device.

The high frequency, high power signal generating device, includes:

- an oscillator, connected to the main circuit of the system through a voltage regulator,
- separating emitter follower, with collector connected to the main circuit and base supplied with the generated by the oscillator main high frequency, and
- interstitial transistor, on which base the high frequency energy from the emitter of the separating emitter follower is provided.

The commutation of the interstitial transistor is synchronized to the ignition signal by an electronic key circuit. The key circuit activates the interstitial transistor, and causes it to pass, in synchronism with the ignition signal, the high frequency signal generated by a high frequency generator. The high frequency transformer's primary winding is connected to the lead of the interstitial transistor, while its secondary winding is connected to the base of a power transistor. The power transistor is connected to the one end of the secondary winding of a step-up transformer, and its other end is connected through a diode, to the main circuit, and to the one end of the secondary winding of the step-up transformer, as well as to the output of the convertor, that is part of the main circuit of the system.

The other end of the transformer's secondary winding, is connected to the high voltage distributor through an high voltage diode, and the step-up transformer is tuned in resonance with the oscillating frequency of the oscillator. This is how, the ignition high voltage, high frequency, rectified signal with negative polarization, is synchronized to the ignition signal.

A special feature of the system is the fact that with the starter switched on, the supply voltage of the power transistor is doubled by virtue of a convertor circuit.

Another feature of the present invention is that, the high frequency signal generating device, includes an integral binary-decimal counter, which is connected to the ignition signal, and every output lead of the counter is supplied with its own high voltage, high frequency circuit.

The high frequency circuit includes:

- electronic key, connected to the correspondent output lead of the counter,
- interstitial transistor,
- high frequency interstitial transformer,
- power transistor,
- step-up transformer, and high voltage diode.

The high frequency oscillator and the separating emitter follower are connected to every individual high voltage, high frequency circuit through the output of the emitter of the emitter follower, while the interstitial transformer is connected to every individual high voltage, high frequency circuit through its output of increased supply voltage and the sparkplug's ignition is by high voltage, high frequency rectified signal with negative polarization generated on the output of every high voltage, high frequency circuit and provided directly to the sparkplug.

Another aspect of the invention is, that the ignition system produces an alternating, high frequency voltage, that is caused to resonate in conjunction with the spark plug's capacitance without rectifying the ignition signal delivered to the spark plug.

The present invention is capable of delivering ignition pulses having more than 55 mJ of energy. This power high frequency ignition system, allows the engine to function with lean air/fuel mixtures in the range of 20 kilograms air to 1 kilogram fuel (gasoline), without any loss of engine power. Beside this, the high voltage provided to the ignition sparkplug is kept constant independent of engine rotational speed and the number working cylinders.

Tests of the present invention on a four cylinder showed that an engine furnished with the ignition system of the present invention:

- functions quietly with an average noise reduction of 12 db;
- the engine functions without any corrections of the "ignition moment", over a wide range of octane number: from 86 (low-octane) to 105 (high-octane);
- as it could be seen, the engine is much more responsive;

the un-incinerated gas present in the exhaust is approximately equal to the exhaust of a vehicle fitted with a catalytic convertor.

BRIEF DESCRIPTION OF THE DRAWINGS

FIG. 1. is a schematic of a first embodiment of the ignition system of the present invention.

FIG. 2. is a schematic second embodiment of the ignition system of the present invention using a distributor less scheme.

DETAILED DESCRIPTION OF THE PREFERRED EMBODIMENTS

The ignition system of the present invention, is shown in FIG. 1. It includes a source of low voltage (1), that is connected to the main circuit (2); high voltage distributor (3), for supplying the ignition pulse to the sparkplug associated with a combustion chamber of the engine; (4) sparkplug; (5) contact key, for applying voltage to the system; (A) source of ignition signal (synchronous with engine speed) from the engine (not shown); and a high frequency, high power signal generating device (6), as a part of the main circuit and designed to produce on its output (B) a high voltage, high frequency electrical signal with negative polarization, synchronized to the ignition signal (A). The high voltage distributor 3 is supplied with that signal, for distributing the engine's ignition pulses.

Convertor circuit (7) produces a signal for primary ignition which is supplied from the starter's feed voltage. It also raises (doubles) the voltage from the battery for providing additional ignition power at its output(b) to assist in starting the engine.

Oscillator (8) generates the high frequency signal to separating emitter follower's (T3) base, and which oscillator supplies the commuted high frequency energy transistor's base with the high frequency energy. In a preferred embodiment the frequency of the signal outputted by oscillator (80 is generally from about 20 thousand cycles per second to about 50 thousand cycles per second. There may even be benefits gained by using a frequency greater than 50 thousand cycles per second. Electronic key circuit (9) controls the interstitial transistor's commutation. The electronic key (9) is connected to the main circuit (2) and designed to produce rectangular impulses, synchronized with the ignition signal (A) that comes from the engine. Through those impulses, the electronic key (9) controls the high frequency voltage that supplies the interstitial transistor's (T2) base from the separating emitter follower (T3), activating the interstitial transistor (T2) in time with the ignition timing requirements. Controlled by this way, high frequency energy is transferred on the high frequency interstitial transformer (L2), which primary winding is connected to the interstitial transistor's (T2) collector and to the main circuit (2) of the system. The secondary winding of the high frequency interstitial transformer (L2) is connected to the end of the power transistor's (T1) base, whose collector is connected to the one end of the primary winding of the step-up transformer (L3), that is tuned in resonance to the oscillator (8). The second end of the primary winding of the step-up transformer (L3), is connected to the main circuit (2) through diode (D1). This is how, the diode (D1) supply the step-up transformer (L3) with direct feed voltage, after the work of the transformer (7) is switched off.

The lead of the primary winding of the step-up transformer (L3) is connected and with the output of the raised feeding voltage (b) of the convertor (7), which voltage is activated only at the engine's starting moment. To this lead of raised feeding voltage (b) is connected and the one lead of the step-up transformer (L3) secondary winding. At the other lead of the step-up transformer's (L3) secondary winding is connected high voltage diode (D2), for half-wave rectification of the signal generated on the secondary winding's output of the step-up transformer (L3). The desired high voltage, high frequency signal with negative polarization for the sparkplug, is obtained on output (B). The ignition system of the present invention works as follows.

The contact key (5) is switched on and through the main circuit (2) thereby supplying power to the system. The engine is started by the contact key (5), and the convertor (7) is switched on. Converter 7 increases the battery's voltage two times. Through output(b), the voltage supplies the feeding lead of the step-up transformer's (L3) primary winding and on the secondary winding. This raised voltage is present only upon starting the engine. Simultaneously, the oscillator (8) generates the high frequency, through the separating emitter follower (T3) thereby supplying with high frequency energy, the base of the commuting high frequency energy interstitial transistor (T2).

The interstitial transistor's (T2) commutation is controlled by the electronic key circuit (9), so the high frequency energy supplied from the separating emitter follower (T3) on the interstitial transistor's (T2) base, is synchronized with the ignition timing that is generated from the ignition signal (A) and conditioned by the electronic key (9). After this, the interstitial transistor (T2), through the interstitial transformer (L2), supplies the power transistor's (T1) base with high frequency impulses. The transistor (T1) amplifies the signal in resonance with the step-up transformer (L3) and a high voltage, high frequency signal is received at its output. This signal, is rectified once by the high voltage diode (D2) and is supplied to the high voltage distributor (3)(as a high voltage, high frequency rectified voltage with negative polarization). When the starter is switched off, the feeding voltage is provided directly to the step-up transformer (L3), through diode (D1).

One variant the ignition system for gasoline engines, according to the invention, is shown in FIG. 2. With this variant, the high voltage high frequency rectified voltage with negative polarization obtained at the output of the device B, is supplied directly to the ignition sparkplug (4'), and the high voltage distributor (3) shown in FIG. 1, is not used here; but rather a noncontact distribution of the high voltage, high frequency, rectified, with negative polarization, is achieved. This is made possible by including to the system of one integral binary-decimal counter (10), at which input the primary signals for indicating engine crank condition (from the engine) are supplied. Those signals are ignition signal (A') and reducing-to-zero signal (O). The number of the integral binary-decimal counter's (10) manifolds are equal by to the number of the engine's cylinders. In the variant of FIG. 2, the integral binary-decimal counter (10) is shown for use with an eight-cylinder's engine.

The high frequency, high power signal generating device (6'), is adapted to the mentioned integral binary-decimal counter (10), where one part of the device's elements are connected to every counter's lead, and other part of the device's elements are general for the system and supply all integral binary-decimal counter's leads. Thus, every integral binary-decimal counter's lead has it's one individual high voltage high frequency circuit (11), for each sparkplug. Every individual high voltage high frequency loop (11) consists of: electronic key (9'), connected to the corresponding integral binary-decimal counter's (10) lead; interstitial transistor (T'2); high frequency interstitial transformer (L'2); power transistor (T'1); step-up transformer (L'3) and high voltage diode (D'2). These listed elements are connected to the system in the same way, as it was described at the first variant, and have the same purpose.

FIG. 2 shows the individual high voltage high frequency loop (11), only for the first integral binary-decimal counter's lead, corresponding for example to the first engine cylinder (the engine is not shown), but it means that the described individual high voltage high frequency circuit (11) is duplicated according to the number of engine cylinders.

The oscillator (8'), the voltage regulator (St'), the separating emitter follower (T'3), the convertor (7'), and the binary-decimal counter are general for the system. The counter is connected to the regulated voltage, where the connection of the individual high voltage high frequency circuit (11) to the mentioned general elements, is by the output (x) at the emitter of the emitter follower (T'3) and by the convertor (7') output (b) of increased feeding voltage.

If another variant of the system for battery's ignition of gasoline engines is accomplished, according to the invention, it is possible the high voltage high frequency starting signal obtained on the step-up transformer's (L'3) secondary winding to be not rectified and to be supplied directly to the respective ignition sparkplug (4'). In this case, it is in resonance with the ignition sparkplug's (4') capacity, and the starting is by alternating high frequency voltage.

We claim:

1. An ignition control system for internal combustion engines, comprising:

means for accepting a signal indicative of engine speed, a high frequency generator for generating a high frequency signal, commutating means for commutating said high frequency signal with said engine speed signal to output a commutated, high frequency signal, amplifying means coupled to said commutating means for amplifying said commutated, high frequency signal output by said commutating means, and converting means coupled to said amplifying means for raising a starter feed voltage, wherein said converting means provides ignition power to said engine during engine start-up.

2. The ignition control system of claim 1, wherein said amplifying means includes a step-up transformer.

3. The ignition control system of claim 2, wherein the transformer is tuned to resonate at the frequency generated by said high frequency generator.

4. The ignition control system of claim 1, wherein said means for accepting a signal includes a binary-decimal counter.

5. The ignition control system for internal combustion engines of claim 1, wherein said high frequency signal is generally equal to or greater than 20 thousand cycles per second.

6. The ignition control system for internal combustion engines of claim 5, wherein said high frequency signal is generally less than or equal to 50 thousand cycles per second.

7. An ignition system for internal combustion engines, comprising:

a high voltage, high frequency circuit having a rectified output voltage, said high voltage, high frequency circuit including, a high frequency oscillator coupled to the base of a first transistor, an electronic key circuit adapted to receive a signal indicative of engine speed, a second transistor coupled to said oscillator and said key circuit, for commutating, the high frequency, signal generated by said high frequency generator in synchronism with said engine speed signal, a power amplifier coupled to said second transistor for employing the commutated signal output by said power amplifier, a step up transformer coupled to said power amplifier, a diode coupled between said step-up transformer and a high voltage distributor, wherein said diode provides said distributor with a rectified negative polarization voltage.

8. The ignition system of claim 7, wherein said output signal of said high frequency circuit is not greater than 50 thousand cycles per second.

9. The ignition system of claim 7, wherein said step up transformer is tuned in resonance with the oscillating frequency of the high-frequency oscillator.

10. The ignition system of claim 7, further including a voltage multiplier coupled to said step-up transformer.

11. The ignition system of claim 7, wherein said key circuit includes a binary-decimal counter.

12. The ignition system of claim 7, wherein said converting means raises the starter feed voltage by a factor of 2.

13. The ignition system of claim 7, wherein said high frequency circuit outputs a high frequency signal generally at least as high as 20 thousand cycles per second.

14. An ignition system for internal combustion engines, comprising:

a high voltage, high frequency circuit having a rectified output voltage, said high voltage, high frequency circuit including, a high frequency oscillator coupled to the base of a first transistor, an electronic key circuit adopted to receive a signal indicative of engine speed, a second transistor coupled to said oscillator and said key circuit, for commutating the high frequency signal generated by said high frequency generator in synchronism with said engine speed signal, a power amplifier coupled to said second transistor for employing the commutated signal output by said power amplifier, a step up transformer coupled to said power amplifier, a diode coupled between said step-up transformer and a spark plug, wherein said diode provides said distributor with a rectified negative polarization voltage.

* * * * *